United States Patent [19]

Mahar

[11] 4,186,850

[45] Feb. 5, 1980

[54] GASOLINE PUMP ASSEMBLY AND LOCK ARRANGEMENT ESPECIALLY SUITABLE FOR USE THEREWITH

[75] Inventor: Joseph A. Mahar, San Francisco, Calif.

[73] Assignee: Mahar & Parsons, Belmont, Calif.

[21] Appl. No.: 901,650

[22] Filed: May 1, 1978

[51] Int. Cl.[2] ..... B67D 5/24

[52] U.S. Cl. ..... 222/28; 222/153

[58] Field of Search ..... 222/14, 15, 17, 20, 222/16, 153, 28, 30

[56] References Cited

U.S. PATENT DOCUMENTS 3,459,330 8/1969 Bickford et al. ..... 222/20 X 4,004,715 1/1977 Williams et al. ..... 222/153 X

*Primary Examiner*—Stanley H. Tollberg

*Attorney, Agent, or Firm*—Flehr, Hohbach, Test, Albritton & Herbert

[57] ABSTRACT

A gasoline pump assembly is disclosed herein and includes an assembly housing, a dispensing nozzle located outside the housing and a pump located within the housing for providing gasoline flow to the nozzle. The assembly also includes a handle movable between two positions for opening and closing the flow of gasoline from its supply to its nozzle and a key actuated arrangement connected with the housing for releasably locking the handle in its flow closing position.

14 Claims, 12 Drawing Figures

GASOLINE PUMP ASSEMBLY AND LOCK ARRANGEMENT ESPECIALLY SUITABLE FOR USE THEREWITH

BACKGROUND OF THE INVENTION

The present invention relates generally to gasoline pump assemblies and more particularly to a handle locking arrangement which is especially suitable for use in a self-service gasoline pump assembly.

Today, more and more gasoline service stations are providing self-service islands for their customers. Inasmuch as the station attendant is normally not present when the gas is pumped from these islands, it is incumbent upon the proprietor to provide some sort of mechanism to prevent motorists from resetting the pump register to zero and then paying for substantially less gas pumped after the register has been reset. There are no doubt a number of ways this has been accomplished. For example, some gasoline pumps which are specifically manufactured for self-service use interlock arrangements for preventing the register from being reset. Mechanical actuated arrangements of this type have been provided as well as those which are electrically actuated from a central console typically located near the cashier's booth.

As will be seen hereinafter, the present invention is also directed to an interlock arrangement for a gasoline pump and particularly to a key actuated interlock arrangement which is specifically designed for locking the handle of a gasoline pump assembly in its flow preventing position. As will also be seen hereinafter, this arrangement in both of its embodiments to be described is uncomplicated in design, economical to provide and especially adapted for easy installation into existing gasoline pumps which were not originally designed for self-service use.

OBJECTS AND SUMMARY OF THE INVENTION

One object of the present invention is to provide an overall gasoline pump assembly which is especially suitable for self-service use.

Another object of the present invention is to provide an arrangement for interlocking the handle of a gas pump assembly in its shut off position, especially one which is readily adapted for easy installation in an existing gasoline pump so that the latter can be readily used in a self-service island.

Still another object of the present invention is to provide an economical handle interlocking arrangement for use in a gasoline pump assembly and particularly one which is uncomplicated in design, easy to operate and yet reliable in use.

A typical gasoline pump assembly includes an assembly housing, a dispensing nozzle located outside the housing and a pump located within the housing for providing gasoline flow to the nozzle from a supply located underground. This assembly also includes a handle of some sort which is mounted on the housing for movement between a first position for closing the flow of gasoline from the supply to the nozzle and a second position for opening gasoline flow to the nozzle. It may also include a local register, that is, one located within its housing, for registering the amount of gasoline which flows through its nozzle, as well as other conventional components.

In accordance with the present invention, the gasoline pump assembly also includes an arrangement adapted for connection with its housing for releasably locking the handle in its first flow closing position. In order to accomplish this, the arrangement utilizes a locking member, specifically a longitudinal locking pin in a preferred embodiment. This locking pin is supported for movement between a first interlocked position with the handle when the latter is in its flow closing first position for preventing the handle from moving to its flow opening second position, and a second non-interlocked position out of the path of movement of the handle. The arrangement also includes key actuated means for moving the locking member from its first interlocked position to its second, non-interlocked position.

Two specific embodiments of this handle locking arrangement comprising part of the overall pump assembly will be described in more detail hereinafter. As will be seen, one embodiment is especially suitable for use in a gasoline pump assembly having a mechanically actuated register while the other is especially suitable for use in a gasoline pump assembly having an electrically actuated register. However, as will also be seen, the handle locking arrangement constructed in accordance with either embodiment of the present invention is uncomplicated in design, easy to operate and reliable in use.

DETAILED DESCRIPTION AND PREFERRED EMBODIMENTS

Figure 1:
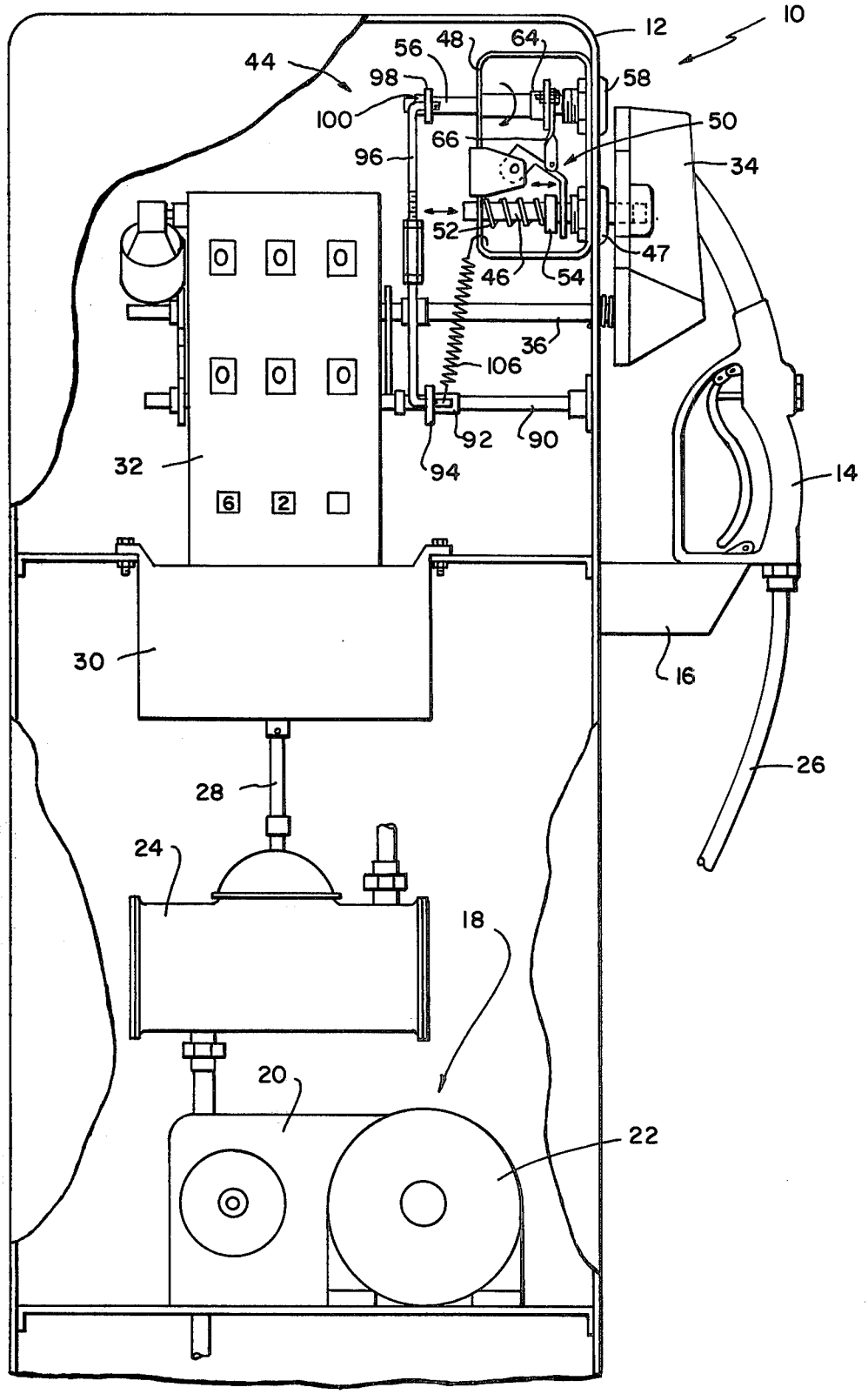
FIG. 1 is a partially broken away front elevational view of a gasoline pump assembly including a handle interlock arrangement constructed in accordance with one embodiment of the present invention.

Turning now to the drawings, wherein like components are designated by like reference numerals throughout the various figures, attention is first directed to a gasoline pump assembly 10 best illustrated in FIG. 1. This assembly, which is especially suitable for self-service use, as will be seen, includes a standard housing or enclosure 12, a dispensing nozzle 14 located outside but supported to the assembly housing by suitable means such as bracket 16 and a pump arrangement 18 located within the housing for providing gasoline flow to the nozzle from a gasoline supply (not shown). This pump arrangement includes a pump 20 which is driven by suitable means, for example, by electric motor 22, for pumping gasoline to nozzle 14 through a meter 24 and through a flexible hose 26 having its outer end connected to the nozzle, actually to a manually actuated valve within the nozzle. As illustrated in FIG. 1, meter 24 is connected by a shaft 28 to a speed change mechanism or variator 30 which, in turn, is connected to a register 32.

The various components of gasoline pump assembly 10 thus far described are or may be conventionally provided by those with ordinary skill in the art and, hence, no further description need be provided. Moreover, it is to be understood that this assembly may and most probably does include other conventional components which are not necessary to the present invention and, hence, will not be described.

Figure 2:
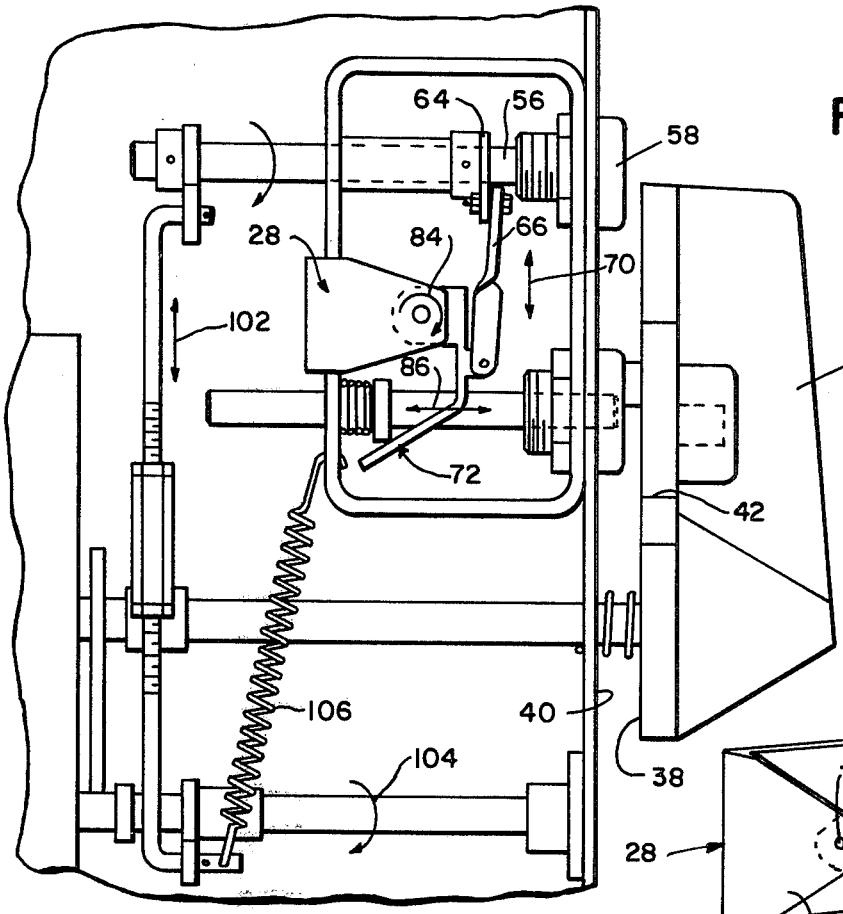
FIG. 2 is a partially broken away and enlarged front elevational view of the interlock arrangement illustrated in FIG. 1.

In addition to these conventional components, gasoline pump assembly 10 includes a handle 34 which is located outside housing 12 and which is mounted to one end of a shaft 36 extending into the housing. This shaft is rotatably mounted in a conventional way within housing 12 and is conventionally interlocked with pump arrangement 18 through, for example, register 32, so that handle 34 is movable between a first position for closing the flow of gasoline to the nozzle and a second gasoline flow opening position. As best illustrated in FIG. 2, this handle includes an inner surface 38 which is located sufficiently close to and facing an outer surface 40 of housing 12 so as not to be readily accessible. The handle also includes an interlock opening 42 which extends into inaccessible surface 38 and which is provided for reasons to be discussed hereinafter. For the moment, it should suffice to say that surface 38 of handle 34 extends parallel to surface 40 of housing 12 as the handle moves between its flow closing and flow opening positions. This, in turn, locates opening 42 in an appropriate position for closing gasoline flow (indicated by the solid lines in FIG. 4) or a flow opening position (indicated by dotted lines). In this regard, assembly 10 may include an appropriate limit pin 44 mounted to and extending out from surface 40 of housing 12 for preventing handle 34 from inadvertently being moved beyond its flow closing position.

In order to lock handle 34 in its flow closing first position, gasoline pump assembly 10 includes handle lock arrangement 44 which is constructed in accordance with one embodiment of the present invention. As will be discussed in more detail hereinafter, this arrangement includes a locking member 46, actually a longitudinally extending locking pin in its preferred embodiment. This arrangement also includes an open ended bearing 47 comprising part of an overall support frame 48 which, among other functions, supports locking member 46 for movement between two positions, e.g., a first position interlocked with handle 34 when the latter is in its flow closing first position for preventing the handle from moving to its flow opening second position and a second, non-interlocked position out of the path of movement of the handle. The locking member is actually moved between these positions by means of an overall key actuated mechanism which is generally designated by the reference numeral 50 and which also comprises part of the overall handle locking arrangement 44. As will be seen hereinafter, this particular mechanism is especially adapted for connected with a mechanically actuated register for automatically resetting the latter when the locking member is moved from its interlocked position to its non-interlocked position.

As stated above, locking member 46 is preferably a longitudinal locking pin. As illustrated in both FIG. 1 and FIG. 2, this longitudinal pin is at least partially located within housing 12 and is axially movable through bearing 48 between its interlocked position such that one end portion thereof extends outwardly beyond the outer surface 40 (FIG. 1) and its non-interlocked position (FIG. 2). As stated previously, handle 34 is movable between its flow closing and flow opening positions in a direction parallel to surface 40 and, hence, moves in a direction normal to that of locking pin 46. With the handle in its flow closing position illustrated in FIG. 1, its interlock opening 42 is in position to receive the locking pin when the latter moves to its outwardly protruding interlocked position, thereby preventing the handle from moving to its flow opening position. By the same token, when the locking pin is retracted it its non-interlocked position, as seen in FIG. 2, the handle is free to move to its flow opening position. In this embodiment, the locking pin is biased in its extended position by means of spring member 52 located concentrically around a section of the locking pin between frame 48 and a fixed lock not 54 located on the locking pin a predetermined distance from its inwardly located end.

Figure 4:
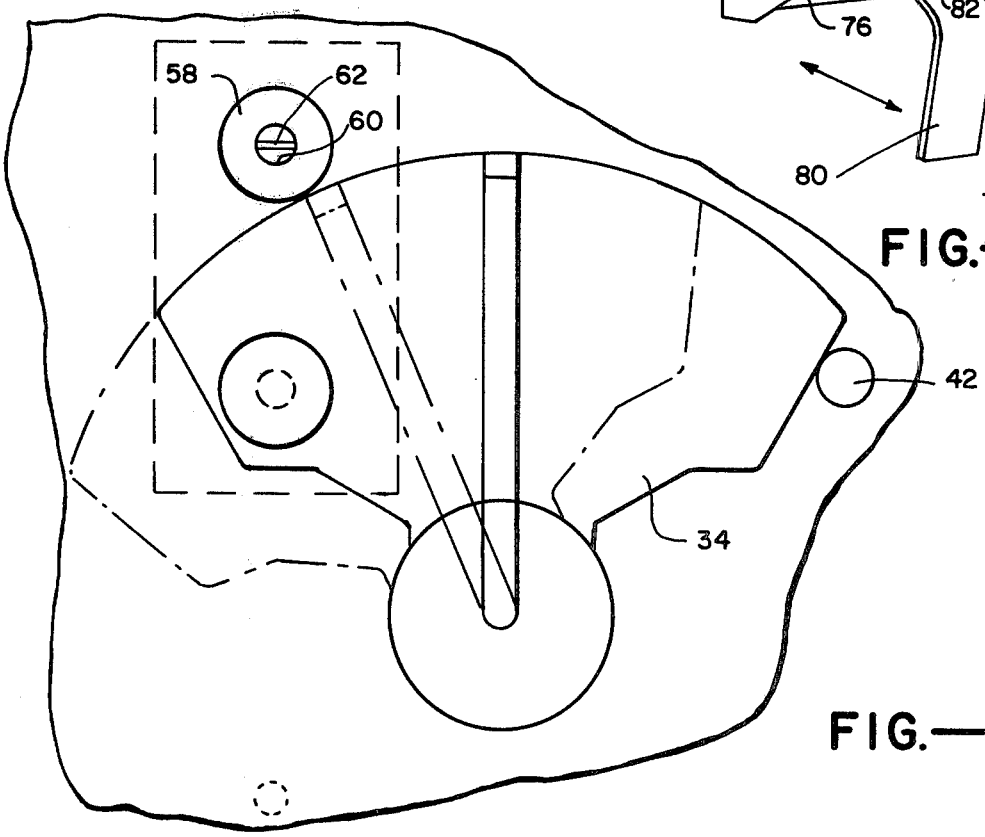
FIG. 4 is an enlarged side elevational view of the pump assembly in FIG. 1, specifically illustrating the pump assembly handle in its gasoline flow closing position.

In order to hold locking pin 46 between the two positions described, key actuated mechanism 50 includes a longitudinal shaft 56 mounted for rotation about its axis to a frame 48 just above locking pin 46 and extending in a direction parallel with the locking pin, as illustrated in both FIGS. 1 and 2. In actuality, the front end of shaft 56, that is, the end nearest to surface 40 of housing 12, is rotatably mounted with an open ended bearing 58 which comprises part of support frame 48 and which defines an outwardly projecting key hole 60, as illustrated in FIG. 4. As seen in this latter figure, the front end of shaft 56 is appropriately configured at 62 for interlocking with a separate, external key (not shown) adapted for insertion into the key hole for axially rotating the shaft between a first position illustrated in FIG. 1 and a second position illustrated in FIG. 2. As will be seen below, overall mechanism 50 not only includes this rotatable shaft (and the key) but also an arrangement interconnecting the shaft with locking pin 46 for translating rotational movement of the shaft to straight line movement for moving the locking from its extended, interlocked position to its retracted, non-interlocked position.

The interconnecting arrangement just recited includes a collar for sleeve 64 position concentrically around and keyed to shaft 56 for rotation therewith. A substantially straight, vertically extending interlock link 66 is bolted or otherwise suitably connected at one end to the free end of a substantially horizontally extending link 68 which has its other end fixedly connected to collar 64 for rotation with shaft 56. In this manner, as the shaft rotates from its FIG. 1 position to its FIG. 2 position, collar 64 rotates with it causing the other end of link 68 to move substantially vertically downward. This, in turn, causes link 66 to move substantially vertically downward, as indicated by arrow 70 in FIG. 2. Obviously, as shaft 56 moves back to its initial position in FIG. 1, link 66 moves substantially vertically upward to its initial position.

Figure 3:
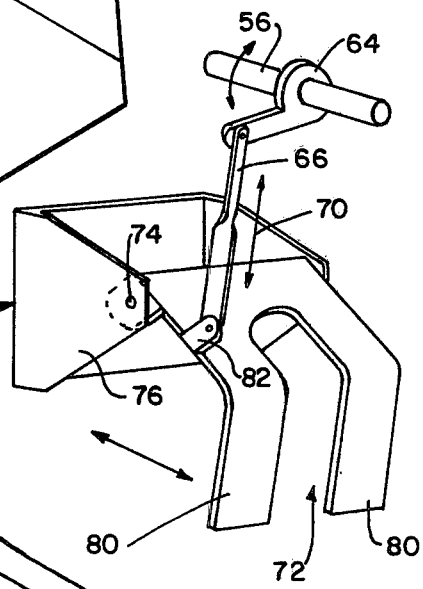
FIG. 3 is a sectional view generally along line 3—3 in FIG. 2, specifically illustrating certain components of the handle interlock arrangement.

In addition to collar 64 and links 66 and 68, the interconnect arrangement referred to above includes a rocker member 72 which is somewhat curved in cross-section as best seen in FIGS. 1 and 2 but which is otherwise best illustrated in FIG. 3. As seen in this latter figure, the top end of the rocker member is pivotally mounted by means of a pivot pin 74 which extends between and is mounted to a pair of spaced-apart flanges 76 comprising part of an overall support bracket 78 suitably mounted to frame 48. Rocker member 72 includes a bottom fork-shaped section having two spaced-apart prongs 80 which are located on opposite sides of locking pin 46 between previously described collar 54 and open ended bearing 47, as best seen in FIGS. 1 and 2. The rocker member also includes a pull tab 82 which is located just above and to one side of one of the prongs 80 and which is bolted or otherwise suitably connected to the otherwise free end of vertically extending link 66. In this way, as link 66 moves downward in the direction of arrow 70, the rocker member is caused to pivot clockwise about pivot pin 74, as indicated by arrow 84, thereby causing prongs 80 to move horizontally against collar 54 in the direction of arrow 86, as illustrated in FIG. 4. This, in turn, caues locking pin 46 to move from its extended, interlocked position to its retracted, non-interlocked position. Obviously, reverse rotation of shaft 56 causes the various movements just described to reverse themselves. However, since locking pin 46 is biased in its extended, interlocked position by means of spring 52, it is not necessary to rotate shaft 56 in this opposite direction by means of a key to reverse these movements.

As stated previously, arrangement 44 may be utilized for automatically resetting register 32 when locking pin 46 is moved from its interlocked position to its non-interlocked position. This is assuming that the register is of the mechanically actuated type including the mechanical actuator generally indicated at 90. In order to provide automatic register reset, actuator 90, which is in the form of a rotatable shaft connected to an appropriate reset mechanism within the register, carries a fixed collar 92 for rotation therewith. This collar, in turn, carries a horizontally extending reset arm 94 which is interlocked at its otherwise free end to the lower end of a somewhat vertically extending link 96. The otherwise free top end of link 96 is interlocked to the otherwise free end of a horizontally extending arm 98 comprising part of and connected with another collar 100 fixedly connected for rotation with shaft 56. In this way, as shaft 56 rotates from the position illustrated in FIG. 1 to the position illustrated in FIG. 2 for moving locking pin 46 from its extended interlocked position to its retracted non-interlocked position, it simultaneously causes link 96 to move vertically downward in the direction of arrow 102 for rotating reset shaft 90 in the direction of arrow 104 for resetting the register. Obviously, as shaft 56 moves back to its initial position, link 96 moves vertically upward causing reset shaft 90 to move back to its initial position. In this regard, the reset shaft may be biased in its initial FIG. 1 position by means of spring 106 connected at one end to the bottom end of link 96 and at its top end to frame 48.

Having described handle lock arrangement 44, attention is now directed to FIGS. 5 to 12 for a discussion of a lock arrangement constructed in accordance with a second embodiment of the present invention. This latter arrangement is generally designated by the reference numeral 110 and may comprise part of an overall gasoline pump assembly 112 which may be otherwise identical to previously described assembly 10. Accordingly, gasoline pump assembly 112 includes an identical housing 12' and may include an identical handle 34' mounted to a shaft 36' for movement between identical flow-closing and flow-opening positions. Moreover, this handle may include an identical surface 38' in confronting relationship with and in close proximity to the surface 40' of housing 12' and an interlock opening 42' extending into surface 38'. Obviously, while not shown, assembly 112 also includes a nozzle which may be identical to nozzle 14, a pump arrangement identical to arrangement 18 and a register which may be identical to register 32, possibly with one exception. The register associated with assembly 112 may or may not include a mechanical actuator, and hence, as will be seen, arrangement 110 (as illustrated) does not include means for interlocking with a mechanical actuator. However, this does not mean that such means could not be readily provided. On the contrary, as will be seen hereinafter, arrangement 110 could be readily modified to include means for interlocking with the mechanical actuator, for example with the previously described shaft 90.

Figure 5:
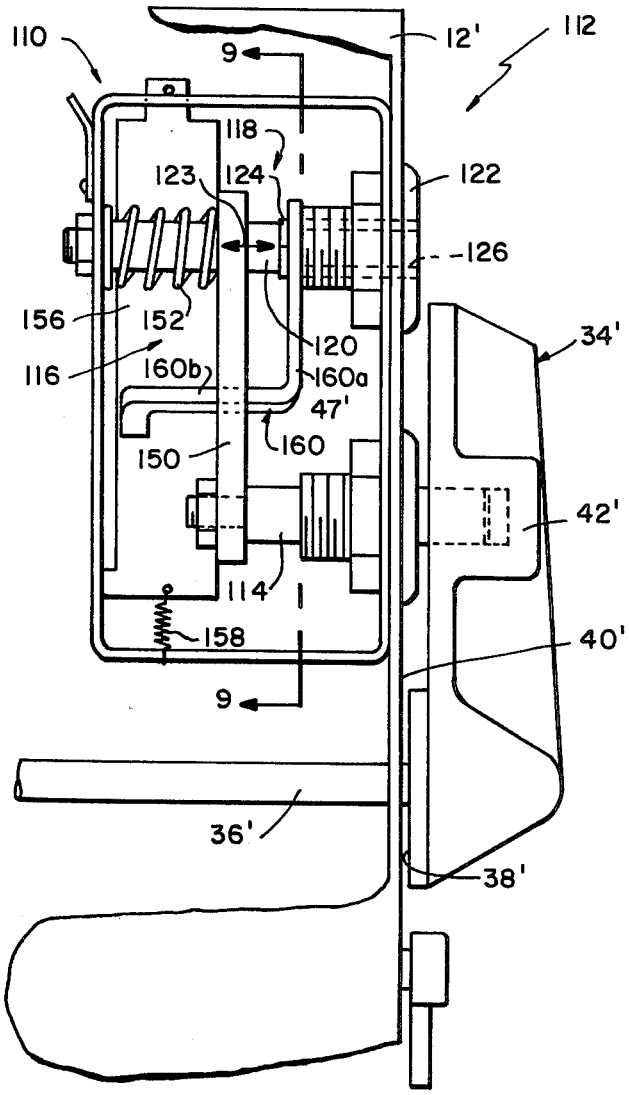
FIG. 5 is a partially broken away front elevational view of a gasoline pump assembly utilizing a handle interlock arrangement constructed in accordance with a second embodiment of the present invention and particularly showing the pump assembly handle in its flow closing position.
Figure 6:
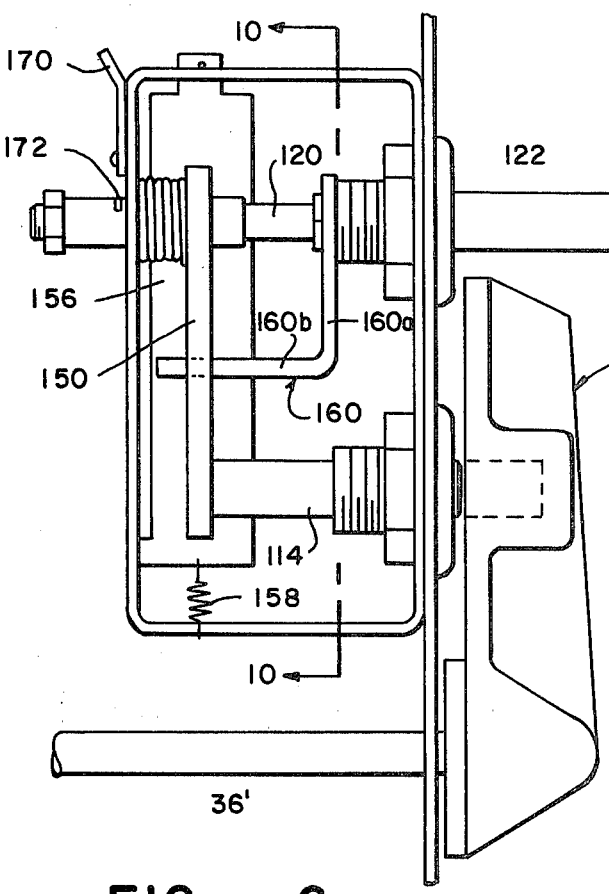
FIG. 6 is an enlarged view of the handle interlock arrangement illustrated in FIG. 5, particularly illustrating this arrangement in its non-interlocked position.

Turning now to handle lock arrangement 110, attention is specifically directed to FIGS. 5 and 6. As illustrated in these figures, locking arrangement 110 includes a support housing 113 which is located within and connected to housing 12' in the same location as previously described housing 48, that is, just inside surface 40' and handle 34', as illustrated in FIGS. 5 and 6. Arrangement 110 also includes a locking member 114, actually a longitudinal locking pin identical to previously described locking pin 46, in a preferred embodiment. Locking pin 114 is actually mounted within a bearing 47' (comprising part of frame 113) for movement between a first position interlocked with handle 34' when the latter is in its flow-closing first position for preventing the handle from moving to its flow-opening second position and a second non-interlocked position out of the path of movement of the handle. In this regard, locking pin 114 and handle 34' are positioned relative to one another in the same way as previously described locking pin 46 and associated handle 34. More specifically, when locking pin 114 is in its interlocked position, a front portion thereof extends beyond surface 40' and into interlock opening 42' of handle 34' when the latter is in its flow closing position, as illustrated in FIG. 5. When this locking pin is in its non-interlocked position, it is actually retracted back into the housing and out of the interlock opening 42', as illustrated in FIG. 6.

Arrangement 110, like previously described arrangement 44, includes a key actuated mechanism for moving locking pin 114 from its extended, interlocked position to its retracted, non-interlocked position. This mechanism, which is generally designated by the reference numeral 116, includes a longitudinal shaft arrangement 118 mounted to frame 113 and extending parallel to locking pin 114 just above the latter. This shaft arrangement includes a central or inner shaft 120 located within an open ended bearing 122 and mounted to frame 113 for axial movement in the directions of arrow 124 between a first position illustrated in FIG. 5 and a second position illustrated in FIG. 6. This inner shaft is best illustrated in FIG. 11 which also shows a second or outer shaft 124 comprising part of the overall shaft arrangement 118. As illustrated in FIG. 11, this second shaft is located concentrically around inner shaft 120, partially within bearing 122 and partially outside the bearing, for rotation about its axis between a first position illustrated in FIG. 5 (best illustrated in FIG. 1) and a second position illustrated in FIG. 6 (best illustrated in FIG. 10).

Figure 7:
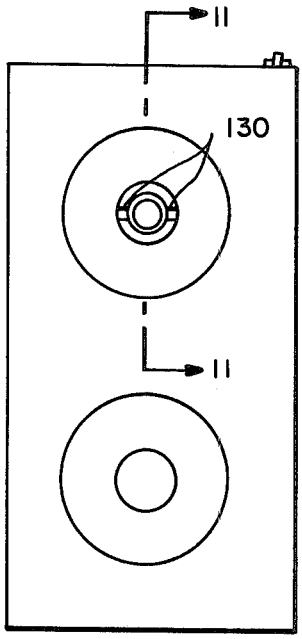
FIG. 7 is a side elevational view of the pump assembly illustrated in FIG. 5, however with the pump assembly handle being omitted for purposes of clarity.
Figure 12:
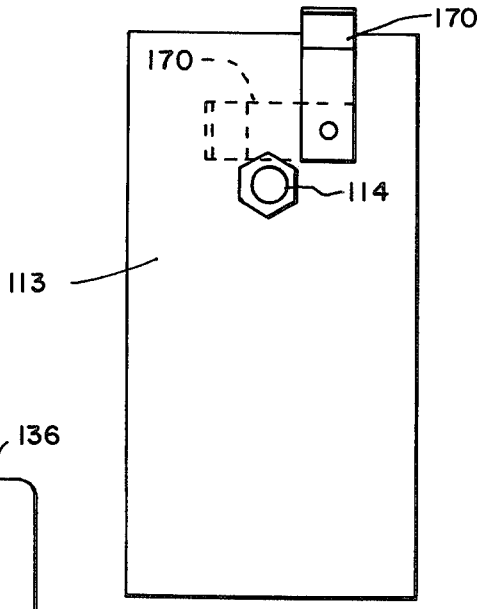
FIG. 12 is a side elevational view of the handle interlock arrangement illustrated in FIGS. 5 and 7.

As just stated, both inner shaft 120 and outer shaft 124 have ends which are located within open ended bearing 122, the latter defining a key hole 126 as best seen in FIG. 7. As illustrated in this latter figure, key hole 126 exposes the free ends of the concentric shafts. Note this end of the outer shaft, that is, rotatable shaft 124, is recessed on opposite sides of inner shaft 120, as indicated at 130, and also note that the front end of inner shaft 120 is inwardly indented at 132, as best seen in FIGS. 7 and 11. As will be seen below, these recesses 130 and the indent 132 cooperate with a key 134 which is illustrated in FIG. 8 and which is provided for substantially simultaneously moving shaft 20 axially from its position in FIG. 5 to its position in FIG. 6 while rotating shaft 124 from its position in FIG. 5 (and FIG. 9) to its position in FIG. 6 (and FIG. 10).

Figure 8:
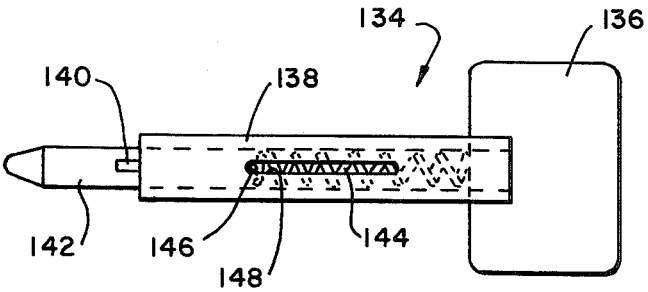
FIG. 8 is a plan view of a key mechanism which comprises part of the arrangement illustrated in FIGS. 5–7.

Turning specifically to FIG. 8, key 134 is shown to include a handle 136 fixedly connected to one end of a cylindrical, hollow outer barrel 138. The free end of this barrel includes a pair of axially projecting teeth 140 which are designed to interlock with previously recited recesses 130 for rotating the outer shaft 124 when barrel 138 is manually rotated while teeth 140 are interlocked into recesses 130. The key also includes a central shaft 142 which is mounted within the free end of barrel 138 for axial movement between the position illustrated and a retracted position completely within the barrel. As illustrated in FIG. 8, shaft 142 includes a somewhat tapered free end which is shaped to reliably engage within previously recited recess 132 in axially movable shaft 120. Shaft 142 is spring loaded in its axially extended position, the position illustrated in FIG. 8, by means of spring member 144 located within barrel 138 between shaft 142 and handle 136. Shaft 142 is prevented from moving beyond its biased, extended position by means of interconnected projection or key 146 extending into the axial slot 148 in barrel 138.

The way in which key 134 operates to simultaneously move the two shafts 120 and 124 first requres that the tapered end of inner shaft 142 be inserted into recess 132 of inner shaft 120 and that the entire key be inserted inward into key hold 126. As will be seen hereinafter, the inner shaft 120 is initially prevented from moving axially to its second position until outer shaft 124 is rotated from its first position to its second position. Accordingly, as the key is exerted into the key hole, the inner shaft 142 is caused to move into barrel 138 so that teeth 140 of the barrel can interlock with recesses 130. With these teeth and recesses so interlocked, the entire key can be rotated for causing outer shaft 124 to rotate from its first position to its second position. This, in turn, frees inner shaft 120 for axial movement, as will be seen, thereby allowing inner shaft 120 to be moved to its second position by the axial force exerted on it by shaft 142 as the latter is forced from its retracted position to its biased extended position by spring 144. As will also be seen hereinafter, this axial movement causes locking pin 114 to move from its interlocked position to its non-interlocked position.

Having described the way that each of the shafts 120 and 124 moves from its position illustrated in FIG. 5 to its position illustrated in FIG. 6 and the way in which this is accomplished by means of key 134, attention is now directed to the particular way in which locking pin 114 moves from its interlocked position in FIG. 5 to its non-interlocked position in FIG. 6 as a result of this key actuated movement of shafts 120 and 124. As illustrated best in FIGS. 5 and 6 in conjunction with FIG. 11, it can be seen that axially movable shaft 120 fixedly carries with it a vertically downwardly depending coupling plate 150 which extends normal to and which is fixedly connected at its bottom end with locking pin 114. In this way, as shaft 120 moves from its FIG. 5 position to its FIG. 6 position, the coupling plate moves with it, thereby causing the locking pin to move from its FIG. 5 (interlocked) position to its FIG. 6 (non-interlocked) position. In a preferred embodiment, shaft 120 and the locking pin are biased in their FIG. 5 position. Accordingly, a biasing spring 152 is located concentrically around a segment of shaft 120 between coupling plate 150 and the back end of frame 113 for applying a biasing force against the back of the coupling plate. For reasons to be discussed below, this coupling plate includes a somewhat centrally located, slightly arcuate slot 154 which is best illustrated in FIGS. 9 and 10 and which extends in a direction somewhat normal to shaft 120 and locking pin 114.

Locking pin 114 is not only biased in its interlocked position (by means of spring 152) but also releasably locked in this position until outer shaft 124 is rotated from its FIG. 5 position to its FIG. 6 position by key 134. This is accomplished by means of a locking plate 156 which is located directly behind and which extends normal to coupling plate 150 when the latter is in its FIG. 5 position. In this way, the locking plate prevents the coupling plate from moving to its FIG. 6 position from its FIG. 5 position.

Figure 9:
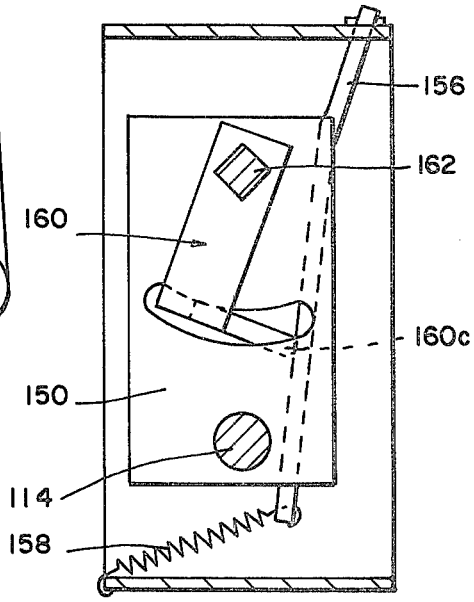
FIG. 9 is a sectional view of the handle interlock arrangement taken generally along line 9—9 in FIG. 5.
Figure 10:
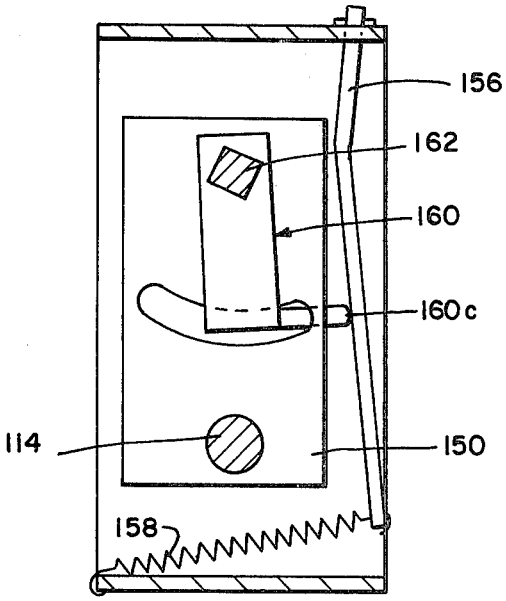
FIG. 10 is another sectional view of the handle interlock arrangement taken generally along line 10—10 of FIG. 7.
Figure 11:
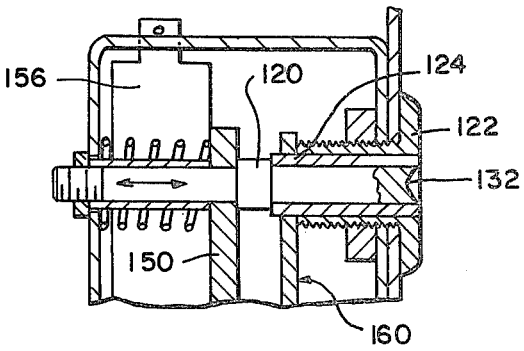
FIG. 11 is still another sectional view of the handle interlock arrangement taken generally along line 11—11 of FIG. 6.

In order to allow coupling plate 150 to move to its FIG. 6 (non-interlocked) position, locking plate 156 is pivotally mounted at its top end with frame 113 so as to be movable between its locking position illustrated in FIGS. 5 and 9 and a spaced, non-interlocking position illustrated in FIGS. 6 and 10. Note that in this latter position, the plate is out of the path of movement of coupling plate 150 so as to allow the latter to move to its FIG. 6, non-interlocked position. However, as illustrated best in FIGS. 9 and 10, locking plate 156 is spring biased in its FIG. 9, locked position by means of a spring member 158 connected between the bottom end of the locking plate and frame 113.

In order to move locking plate 156 from its FIG. 9, locked position to its FIG. 10 position, a trip member 160 is provided. This trip member is fixedly connected at its top end to rotatable shaft 124 by means of a square shaft section 162, as best seen in FIGS. 9 and 10. This trip member extends vertically downward (section 160*a*) as best seen in FIGS. 5 and 6 and thereafter through previously described slot 154 is coupling plate 150 (section 160*b*) as best seen in FIGS. 9 and 10 in conjunction with FIGS. 5 and 6. Finally, the trip member (specifically section 160*c*) extends from behind coupling plate 150 towards and against locking plate 156 as best seen in FIGS. 9 and 10. In this way, as shaft 124 rotates from its FIG. 5 position to its FIG. 6 position, trip member 160 pivots from its FIG. 9 position to its FIG. 10 position causing locking plate 156 to move from its locked FIG. 9 position to its non-locked FIG. 10 position wich, in turn, allows shaft 120 to move from its locked FIG. 5 position to its non-locked FIG. 6 position. This, in turn, causes the locking pin to move from its interlocked position (for maintaining handle 34' in its flow-closing position) to its non-interlocked position (for allowing movement of the handle).

It should be readily apparent that this entire chain of movement ultimately leading to unlocking handle 34' can be carried out by the substantially simultaneous rotation of shaft 124 and axial movement of shaft 120 utilizing key 134 in the manner described previously. It should be equally apparent that the various movements in the chain can be reversed and, in fact, are biased in the reversed direction to maintain the locking pin in its interlocked position.

Both locking arrangements 44 and 110 have been described in their locking modes, that is, in a mode which requires the use of a key to unlock their respective locking pins. Each of these arrangements can however include means for locking the locking pin in its non-interlocked position. For example, as illustrated in FIGS. 5 and 6, arrangement 110 includes a locking plate 170 which is pivotally mounted to the back end of frame 113 for movement between a vertically upstanding position (solid lines) and a somewhat horizontal position (dotted lines). In its vertical solid line position, this locking member is out of engagement with shaft 120 allowing the latter to freely move between its two positions illustrated in FIGS. 5 and 6. However, in its horizontal dotted line position, locking member 170 engages in a cooperating slot 172 provided within shaft 120 when the latter is in its second, non-locking position (FIG. 6). In this way, the shaft is prevented from moving back to its biased locked position, thereby preventing locking pin 114 from moving back to its interlocked position. A similar member of cooperating slots can be provided with arrangement 44.

What is claimed is:

1. A gasoline pump assembly, comprising:
(a) an assembly housing;
(b) a dispensing nozzle located outside said housing;
(c) means including a pump located within said housing for providing a flow of gasoline to said nozzle from a supply thereof;
(d) handle means mounted on said housing for movement between a first position for closing the flow of gasoline from said supply to said nozzle and a second position for opening said flow of gasoline to said nozzle; and
(e) an arrangement connected with said housing for releasably locking said handle means in said first flow closing position, said arrangement including
(i) a longitudinal locking pin at least partially located within said housing,
(ii) means located within said housing and supporting said locking pin for axial movement between a first position such that one end portion of said pin extends out beyond an outer surface of said housing and interlocks with said handle means when the latter is in its flow closing first position for preventing said handle means from moving to its flow opening second position and a second non-interlocked position longitudinally inward from its first position out of the path of movement of said handle means, and
(iii) key actuated means located within said housing for moving said locking pin from its interlocked position to its non-interlocked position, said key actuated means including a key hole accessible from outside said housing and adapted to receive a key for moving said locking pin to its non-interlocked position.

2. An assembly according to claim 1 including means for registering the amount of gasoline flowing through said nozzle and means for resetting said registering means, said locking arrangement including means interconnected with said reset means and said key actuated means for automatically resetting said register means when said locking pin is moved from its interlocked position to its non-interlocked position.

3. An assembly according to claim 1 wherein said handle means is movable in a direction substantially normal to the movement of said locking pin, said handle means including a surface sufficiently close to and facing said outer surface so as not to be readily accessible and an opening into said inaccessible surface for receiving said one end portion of said pin when the latter is in its interlocking position and said handle means is in its flow closing position.

4. An assembly according to claim 1 including means for locking said pin in its inward non-interlocked position.

5. An assembly according to claim 3 including means for biasing said pin in its interlocked position and wherein said key actuated means includes a longitudinal shaft parallel to said pin and mounted to said support means for rotation about its axis in response to rotation of said key within said key hole and means connected with said shaft and said pin for translating said rotation of said shaft to straight line movement for moving said pin to its non-interlocked position in response to the rotation of said shaft.

6. An assembly according to claim 1 wherein said locking arrangement includes means for biasing said pin in said interlocked position and key actuated means for disengagably locking said pin in said interlocked position, said key actuated locking means and said key actuated moving means being interconnected with one another so as to unlock said pin from its interlocked position and at substantially the same time move it to its non-interlocked position by means of a single key located and moved a predetermined way within said key hole.

7. An assembly according to claim 1 wherein said key actuated means includes a longitudinal shaft mechanism extending parallel with said pin, said shaft mechanism being mounted to said support means and including shaft means axially movable between first and second axial positions and a shaft means rotatably movable about its axis between first and second rotated positions, means for biasing both of said shaft means in their respective first positions, means connected with said axially movable shaft means and pin for moving the latter between its interlocked and non-interlocked positions in synchronism with the movement of said axial shaft means between its first and second positions, means connected with said rotatably movable shaft means and said pin locking means for moving the latter between a locked position and an unlocked position in synchronism with the movement of said rotatably movable shaft means between its first and second position, said locking arrangement including key means movable within said key opening in a predetermined way for substantially simultaneously axially moving said axial shaft means and rotatably moving said rotatably movable shaft means for their biased first positions to their second positions.

8. An assembly according to claim 7 wherein said key means includes a first hollow longitudinal section adapted for engagement with said rotatably movable shaft means for rotating the latter upon rotation of said longitudinal section, a second longitudinal section located with said hollow section and movable from a first retracted position within the latter to a second biased extended position for moving said axial shaft means from its first position to its second position.

9. A gasoline pump assembly, comprising:
(a) an assembly housing;
(b) a dispensing nozzle located outside said housing;
(c) means including a pump located within said housing for providing a flow of gasoline to said hozzle from a supply thereof;
(d) handle means mounted to said housing adjacent one surface thereof for movement between a first position for closing the flow of gasoline from said supply to said nozzle and a second position for opening said flow of gasoline to said nozzle, said handle means being movable in a direction parallel with said adjacent surface and including a confronting surface sufficiently close to said adjacent surface so as not to be readily accessible and an inwardly closed opening in said confronting surface; and
(e) an arrangement for releasably locking said handle means in said first flow closing position, said arrangement including:
(i) a longitudinally extending locking pin located at least partially within said housing in a direction normal to the movement of said handle means,
(ii) means located within said housing and supporting said locking pin for movement between a first extended position such that an end portion thereof extends beyond said housing surface and engages within said opening in said handle means when the latter is in its flow closing position for interlocking said handle means in that position and a second retracted non-interlocking position,
(iii) means for biasing said locking pin in its interlocked position,
(iv) key actuated means located within said housing and including a key hole accessible outside said housing, a longitudinal shaft extending parallel with said locking pin and mounted to said support means for rotation between first and second positions about its axis and means connected with said shaft and said pin for moving said pin from its interlocked position to its non-interlocked position as said shaft moves from its first to its second position, and
(v) key means adapted for insertion within said key hole for rotating said shaft from its first position to its second position.

10. An assembly according to claim 9 including means for registering the amount of gasoline flowing through said nozzle and means for resetting said registering means, said locking arrangement including means interconnected with said reset means and said key actuated means for automatically resetting said register means when said locking member is moved from its interlocked position to its non-interlocked position.

11. An assembly according to claim 9 including means for locking said pin in its non-interlocked position.

12. A gasoline pump assembly, comprising:
(a) an assembly housing;
(b) a dispensing nozzle located outside said housing,
(c) means including a pump located within said housing for providing a flow of gasoline to said nozzle from a supply thereof;
(d) handle means mounted on said housing for movement between a first position for closing the flow of gasoline from said supply to said nozzle and a second position for opening said flow of gasoline to said nozzle; and
(e) an arrangement for releasably locking said handle means in said first flow closing position, said arrangement including
(i) a locking member,
(ii) means supporting said locking member for movement between a first interlocked position with said handle means when the latter is in its flow closing first position for preventing said handle means from moving to its flow opening second position and a second non-interlocked position out of the path of movement of said handle means,
(iii) means for biasing said locking member in its interlocked position,
(iv) first key actuated means for moving said locking member from its interlocked position to its non-interlocked position,
(v) second key actuated means for disengagably locking said locked member in its interlocked position, said second key activated locking means being interconnected with said first key actuated moving means so as to unlock said locking member from its locked position and, at substantially the same time, move said locking member from its first interlocked position to its second position by means of a single key engaging said key actuated locking and moving means in a predetermined way, and
(vi) a key for simultaneously engaging both of said key actuating means and, at the same time, being movable in said predetermined way for substantially simultaneously unlocking said locking member and moving it to its non-interlocking second position from its first interlocked position.

13. A lock arrangement especially suitable for locking the handle of a gasoline pump assembly in a position for preventing gasoline from being pumped, said arrangement comprising:
(a) a longitudinally extending locking pin;
(b) means supporting said locking pin for axial movement between a first position and a second position;
(c) means for biasing said locking pin in its first position,
(d) key actuated means including
(i) a key hole,
(ii) a longitudinal shaft extending parallel with said locking pin and mounted to said support means for rotation between first and second positions about its axis, and (iii) means connected with said shaft and said pin for moving said pin from its interlocked position to its non-interlocked position as said shaft moves from its first to its second position; and (e) key means adapted for insertion within said key hole for rotating said shaft from its first position to its second position.

14. A lock arrangement especially suitable for locking the handle of a gasoline pump assembly in a position for preventing gasoline from being pumped, said arrangement comprising:

(a) a locking member;

(b) means supporting said locking member for movement between a first interlocked position with said handle when the latter is in its flow closing first position for preventing said handle from moving to its flow opening second position and a second non-interlocked position out of the path of movement of said handle, (c) means for biasing said locking member in its interlocked position, (d) key actuated first means for moving said locking member from its interlocked position to its non-interlocked position, (e) key actuated second means for disengagably locking said locking member in its interlocked position, said key activated second locking means being interconnected with said key actuated first moving means so as to unlock said member from its locked position and, at substantially the same time, move said member from its interlocked position by means of a single key engaging said key actuated locking and moving means in a predetermined way, and (f) a key for simultaneously engaging both of said key actuating means and, at the same time, being movable in said predetermined way for substantially simultaneously unlocking said member and moving it to its non-interlocking position.

* * * * *